US006784868B2

(12) United States Patent
Murahashi et al.

(10) Patent No.: US 6,784,868 B2
(45) Date of Patent: Aug. 31, 2004

(54) LIQUID CRYSTAL DRIVING DEVICES

(75) Inventors: Shunichi Murahashi, Nabari (JP); Masafumi Katsutani, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 251 days.

(21) Appl. No.: 10/183,374

(22) Filed: Jun. 28, 2002

(65) Prior Publication Data

US 2003/0011549 A1 Jan. 16, 2003

(30) Foreign Application Priority Data

Jun. 29, 2001 (JP) ..... 2001-199947

(51) Int. Cl.[7] ..... G09G 3/36

(52) U.S. Cl. ..... 345/103; 345/89; 345/100; 345/690; 345/204; 345/545; 345/536

(58) Field of Search ..... 345/87–104, 204–206, 345/545–551, 690, 698, 536

(56) References Cited

U.S. PATENT DOCUMENTS 4,679,043 A * 7/1987 Morokawa ..... 345/103
4,816,816 A * 3/1989 Usui ..... 345/103
6,028,587 A * 2/2000 Igari ..... 345/597
6,118,430 A * 9/2000 Igari ..... 345/856

FOREIGN PATENT DOCUMENTS

JP 09-281933 A 10/1997
JP 2000-111874 * 4/2000 ..... G09G/3/36

* cited by examiner

*Primary Examiner*—Lun-Yi Lao
(74) *Attorney, Agent, or Firm*—Birch, Stewart, Kolasch & Birch, LLP.

(57) ABSTRACT

A liquid crystal driving device of the present invention is provided with a display data memory of a capacity that can be divided into two parts, and a switch circuit that is used to switch an addressing method of the display data memory between multi-tone display in a dual-scan and simple-tone display in a single-scan, so as to enable a driving IC to be shared between liquid crystal display devices that are used to display high-quality and multi-tone images and liquid crystal display devices that require less tone. Such a liquid crystal driving device can be used to reduce production cost of various types of liquid crystal display devices.

6 Claims, 12 Drawing Sheets

LIQUID CRYSTAL DRIVING DEVICES

FIELD OF THE INVENTION

The present invention relates to liquid crystal driving devices for driving matrix-type liquid crystal display panels having a tone display capability.

BACKGROUND OF THE INVENTION

Conventionally, there have been proposed various techniques for reducing power consumption of liquid crystal display devices. For example, Japanese Publication for Unexamined Patent Application No. 281933/1997 (Tokukaihei 9-281933) (published on Oct. 31, 1997) discloses a technique in which a display memory is installed in a driver LSI of the liquid crystal panel to limit external access to the display memory when displaying a still image in particular, so that the power consumption of the liquid crystal display device can be reduced.

Such a liquid crystal display device is described below with reference to FIG. 10. It is assumed here that a liquid crystal panel 1003 is used in a matrix-type liquid crystal display device and is AC-driven according to a line-sequential scanning method and a voltage average method, both of which have been commonly used in this type of liquid crystal display.

The liquid crystal panel 1003 has such a structure that an STN liquid crystal element is placed between a pair of glass substrates, wherein, for example, a plurality of segment lines and a plurality of common lines are respectively disposed on the inner surfaces of the glass substrates orthogonal to each other, and each intersection of the segment lines and the common lines makes up a pixel.

Before explaining black-and-white display operations of the liquid crystal display device, an explanation will be given to a liquid crystal driver for use in liquid crystal display devices for portable phones and the like, in which a common driver, a segment driver, a display data memory, and a control circuit of the display data memory are packaged in one chip, for example.

A liquid crystal driver 1002 is provided therein a display data memory 1006, which corresponds one to one to the pixels of the liquid crystal panel 1003. For example, in order to carry out display in 248×68 dots, the display data memory 1006 requires a capacity of 248×68=16864 bits.

The liquid crystal driver 1002 outputs a segment signal that turns the display data memory 1006 to either 0 or 1 for ON/OFF of each pixel of the liquid crystal panel 1003. A line address counter 1009 selects data of one line of the liquid crystal panel 1003 from the display data memory 1006, and the segment signal is sent to the segment driver 1004 in the form of data so selected.

The segment driver 1004, in response to the segment signal, outputs a voltage for driving the liquid crystal panel 1003 according to the display data and feeds it to the segment of the liquid crystal panel 1003.

The display data is applied to the display data memory 1006 according to the data bus width of a CPU 1001, by incrementing the X address and Y address of an X address counter 1007 and a Y address counter 1008.

A common driver 1005 successively outputs line by line a scanning pulse that indicates an ON line of the liquid crystal panel 1003 and feeds it to the common of the liquid crystal panel 1003. ON pixels and OFF pixels of a line are decided by the voltages applied to the common and segment of the liquid crystal panel 1003. By successively driving the common lines, any characters or graphics can be displayed on the liquid crystal panel 1003.

As described, display is carried out on the liquid crystal panel 1003 by the display data memory 1006, the line address counter 1009, the segment driver 1004, and the common driver 1005. Therefore, no transfer of display data is required between the CPU 1001 and the liquid crystal driver 1002 so long as the display remains the same. Further, a change of display is accompanied by data transfer that can be separately carried out from the transfer of display data that is used for the display of the liquid crystal panel 1003. This allows for a slower data transfer speed and thereby reduces power consumption.

The display data memory 1006 corresponds to the pixels, one bit per pixel, so that two-level display of black and white is carried out.

Multi-tone display that displays intermediaries between black and white, rather than two levels of black and white, can be carried out by a frame rate control (FRC) method which realizes multi-tone display by varying the number of times each pixel of the liquid crystal panel 1003 is switched ON when displaying a single display data with a period of plural frames, or by a pulse modulation method in which a pulse width is varied in one frame to change ON time.

In order to carry out multi-tone display by these methods, the capacity of the display data memory 1006 needs to be increased to increase the number of bits per pixel of the memory, and the tone data of each pixel needs to be stored. For example, 3 bits are required for each pixel in display of 8 tones, and 6 bits for 64 tones and 8 bits for 256 tones.

Miniaturization of LSIs has advanced over the last years and it is now possible to increase the capacity of the display data memory 1006 to readily accommodate multi tones and multi colors.

However, increasing the number of display pixels and thus the number of common lines in the liquid crystal panel 1003 shortens the ON time of the liquid crystal pixels in one frame. Thus, when the liquid crystal panel 1003 is used to carry out large-screen or high-resolution display by the frame rate control method or pulse modulation method, flicker is caused in a display of tones with a short ON time and a poor display quality results.

In order to avoid such a problem, there has been proposed a driving method known as a dual-scan display mode, in which two segment drivers are used to simultaneously and respectively drive the upper and lower segments that have been prepared by dividing the display screen of the liquid crystal panel, i.e., the segment lines, into upper and lower parts.

Note that, a simple-matrix display mode in which the display screen of the liquid crystal panel is not divided into upper and lower parts will be called a single-scan display mode.

The dual-scan display mode, compared with the single-scan display mode, requires two driving circuits for the upper part and lower part of the liquid crystal panel, and therefore increases the scale of LSI mounting and the complexity of the driving circuits.

The advantage of the dual-scan display mode over the single-scan display mode, however, is that an ON time twice as long as that of the single-scan display mode (1/2 duty ratio) can be obtained. This prevents flicker on the display screen and improves display quality.

Meanwhile, in order to carry out multi-tone and multi-color display in the matrix-type STN liquid crystal display device while at the same time suppressing power consumption, a driver with a large display memory capacity needs to be used for the driving in the dual-scan display mode.

While such a liquid crystal display device for displaying a high-quality and multi-tone image is in demand, there has also been a demand for low-cost liquid crystal display devices which do not require many tones for display.

It is therefore advantageous, in terms of productivity and cost, to share the driver between these two different types of liquid crystal display devices.

However, an increase of display memory capacity is generally associated with an increase in unit cost of the driver, which increases production cost of the liquid crystal display device. Also, display panels with a small number of tones, because of their low unit sale price, cannot generally afford expensive drivers with a large memory capacity for displaying multi tones. It is therefore required to prepare and use a plurality of different types of drivers having different display memory capacities, according to different numbers of tones required for the display, depending on the use of the driver.

That is, two kinds of drivers are required: one for the liquid crystal display device that carries out high-quality and multi-tone display; and one for the liquid crystal display device that does not require many tones. This is disadvantageous in terms of reducing cost by mass-production. As a result, a high production cost is borne for the liquid crystal display device.

SUMMARY OF THE INVENTION

An object of the present invention is to provide liquid crystal driving devices that require low production cost for various types of liquid crystal display devices, by enabling a single driving IC to be shared between liquid crystal display devices that display high-quality and multi-tone images and liquid crystal display devices that do not require many tones.

In order to achieve the foregoing object, a liquid crystal driving device of the present invention is provided with a display memory which stores display data to be supplied to a matrix-type liquid crystal display panel having pixels that are disposed in row and column directions in a matrix for displaying $2^k$ tones (k being a natural number), and a column driver of m outputs (m being a natural number) and a row driver of n outputs (n being a natural number), and the liquid crystal driving device includes: display memory control means for varying a value n and a value m of m×n×k bits, which is a capacity of the display memory, while holding n×k bits of m×n×k bits constant; and output number setting means for setting a number of outputs of the row driver such that the n value varied by the display memory control means becomes the number of outputs of the row driver.

According to the foregoing liquid crystal driving device, the display memory control means varies value n and value k to change the address of stored display data in the display memory of m×n bits. The change of value n and value k does not bring about a change of a capacity (m×n×k) of the display memory because n×k is held constant.

Varying value k changes the number of tones of the matrix-type liquid crystal display panel, and varying value n changes the number of outputs of the row driver.

Thus, by varying value n and value k, the number of outputs of the row driver can be set according to the number of tones, without changing the capacity of the display memory.

For example, the following considers a matrix-type liquid crystal display panel with 248 segment lines (lines in a column direction) and 64 common lines (lines in a row direction) that is dual-scanned to display 256=(28) tones. Here, k=8.

The dual-scan is a display mode in which two parts of a display screen of the matrix-type liquid crystal display panel, that has been divided in a row direction, are simultaneously driven.

In the dual-scan display mode, the number m of outputs of the column driver is 248, but the number n of outputs of the row driver is 64½=32 since two liquid crystal driving devices are used. Further, since the number of tones is 256, k=8. Here, the capacity of the display memory is 248×32×8=63488 bits.

Further, 248×32 is the number of pixels that are driven by a single liquid crystal driving device, and it indicates the count of addresses of the display memory that stores display data.

The following describes the case where the liquid crystal driving device adapted to the dual-scan is used for the single-scan.

The single-scan is a display mode in which the display screen of the matrix-type liquid crystal display panel is directly driven for display.

The single-scan display mode employs a single liquid crystal driving device and therefore the number of outputs of the column driver is 248 and the number of outputs of the row driver is 64. Here, the product of the number n of outputs of the row driver and the number k of tones is constant and k=4. Accordingly, the number of tones of the matrix-type liquid crystal display panel becomes 24=16. Here, the capacity of the display memory is 248×64×4=63488 bits.

Further, 248×64 is the number of pixels that are driven by the single liquid crystal driving device, and it indicates the count of addresses of the display memory that stores display data.

That is, the dual-scan display mode and the single-scan display mode have different counts of addresses of the display memory that stores display data.

Despite these different display modes with different numbers of tones, the same liquid crystal driving device can be used in the dual-scan display mode as well as in the single-scan display mode by varying a value n and a value m of m×n×k bits, which is a capacity of the display memory, while holding n×k bits of m×n×k bits constant, and setting a number of outputs of the row driver such that the n value varied by the display memory control means becomes the number of outputs of the row driver.

By thus enabling the same liquid crystal driving device to be shared between different display modes with different numbers of tones, the effect of mass-production can be expected. That is, the cost per liquid crystal driving device can be reduced, thereby reducing the production cost of the liquid crystal display device.

Further, because the capacity of the display memory remains the same regardless of the number of tones, the cost of the liquid crystal driving device will not be increased by an increased memory capacity.

In order to achieve the foregoing object, another liquid crystal driving device of the present invention is provided with a display memory which stores display data to be supplied to a matrix-type liquid crystal display panel having pixels that are disposed in row and column directions in a matrix, and column and row drivers for driving the matrix-type liquid crystal display panel, and the liquid crystal driving device includes: setting means for setting a count of addresses of a display data storing area of the display memory, so as to set a number of outputs of the row driver according to the count, wherein the setting means varies the count of addresses between a dual-scan display mode in which two parts of a display screen of the matrix-type liquid crystal display panel, that has been divided into two parts in a row direction, are simultaneously driven to carry out display, and a single-scan display mode in which the display screen of the matrix-type liquid crystal display panel is directly driven to carry out display.

According to this liquid crystal driving device, the count of addresses of the display data storage area of the display memory is varied between the dual-scan display mode and the single-scan display mode, and the number of outputs of the row driver is changed according to this count. This enables the same liquid crystal driving device to be used between liquid crystal display devices of the single-scan display mode and liquid crystal display devices of the dual-scan display mode.

By thus enabling the same liquid crystal driving device to be shared between different display modes (dual-scan display mode and single-scan display mode) with different address counts of the display data storage area of the display memory, the effect of mass-production can be expected. That is, the cost per liquid crystal driving device can be reduced, thereby reducing the production cost of the liquid crystal display device.

For a fuller understanding of other objects, the nature and advantages of the invention, reference should be made to the ensuing detailed description taken in conjunction with the accompanying drawings.

DESCRIPTION OF THE EMBODIMENTS

[First Embodiment]

Figure 1:
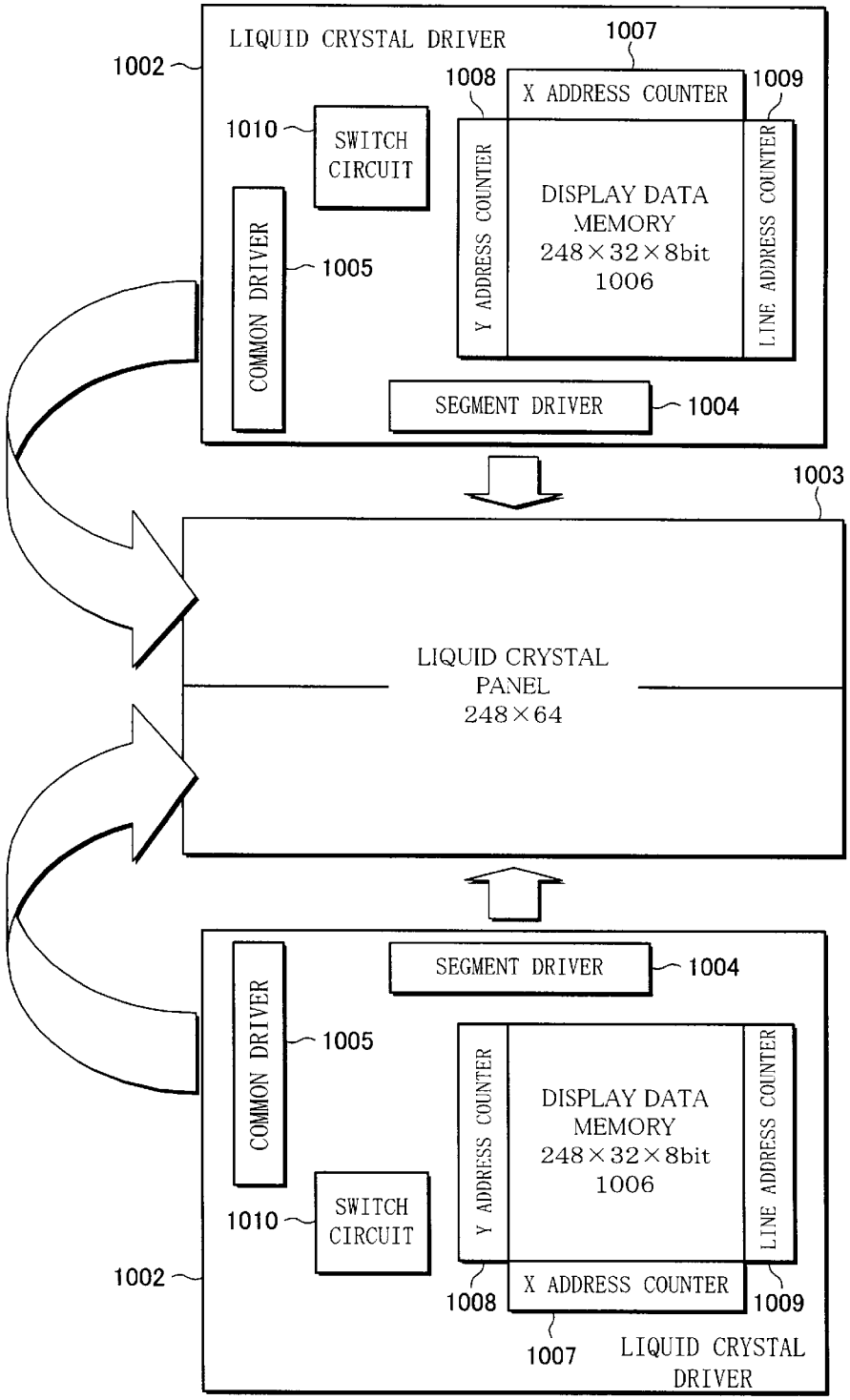
FIG. 1 is a drawing schematically showing a structure of a liquid crystal display device of a dual-scan display mode, provided with a liquid crystal driving device of the present invention.

The following will describe one embodiment of the present invention. FIG. 1 of the embodiment illustrates a liquid crystal display device of a dual-scan display mode, and FIG. 2 of the embodiment illustrates a liquid crystal display device of a single-scan display mode.

First, referring of FIG. 1, the liquid crystal display device of the dual-scan display mode is described below.

A liquid crystal panel 1003 shown in FIG. 1 is a matrix-type STN liquid crystal display panel with 248 segment lines and 64 common lines, capable of displaying $2^k$ tones (k is a natural number). In the dual-scan display mode, the number of tones is 256 and therefore k=8.

A liquid crystal driver (liquid crystal driving device) 1002 is a single-chip LSI that is realized by: a common driver (row driver) 1005 with n (n is a natural number) outputs for driving 32 lines; a segment driver (column driver) 1004 with m (m is a natural number) outputs for driving 248 lines; a display data memory (display memory) 1006 with a capacity of m×n×k=248×32×8 bits; a control circuit (not shown) for controlling the display data memory 1006; and a switch circuit (output number setting means, setting means) 1010 which switches an area of the display data memory 1006 between a pixel area and a tone display area.

The control circuit (display memory control means) for controlling the display data memory 1006 is realized by an X address counter 1007, a Y address counter 1008, a line address counter 1009, an interface circuit (not shown) which receives a control signal from an external CPU, a command decoder (not shown), and the like.

The Y address counter 1008 and the line address counter 1009 have the address space of 64 lines.

In the dual-scan display mode, two liquid crystal drivers 1002, respectively provided for the upper and lower parts of the liquid crystal panel 1003, operate to drive 248×32 pixels of their respective areas. Thus, the switch circuit 1010 switches the area of the display data memory 1006 so that the Y address counter 1008 and the line address counter 1009 count the addresses of 32 lines to enable display of 248×32 (number of pixels)×8 bits, i.e., the display of 256 tones.

In the single-scan display mode, on the other hand, a single liquid crystal driver 1002 (additionally provided with a common driver 1011 as will be described later) operates to drive 248×64 pixels. Thus, the switch circuit 1010 switches the area of the display data memory 1006 so that the Y address counter and the line address counter count the addresses of 64 lines to enable display of 248×64 (number of pixels)×4 bits, i.e., the display of 16 tones.

For tone display, the segment driver 1004 receives display data of one line, i.e., 248 pixels, from the display data memory 1006 and stores it in a hold memory (not shown) inside the segment driver 1004. The display data is latched for one horizontal synchronize period, and, in the case of pulse width modulation for example, is outputted to each segment line of the liquid crystal panel 1003 with a pulse width that is selected by a tone pulse selecting circuit (not shown) according to the display data.

In order to display an image, the common driver 1005 successively selects the common lines of the 32-line liquid crystal panel 1003 per one horizontal synchronize period to output a scanning signal (one each for the upper and lower parts). That is, the scan is made twice in one frame to display an image.

Figure 2:
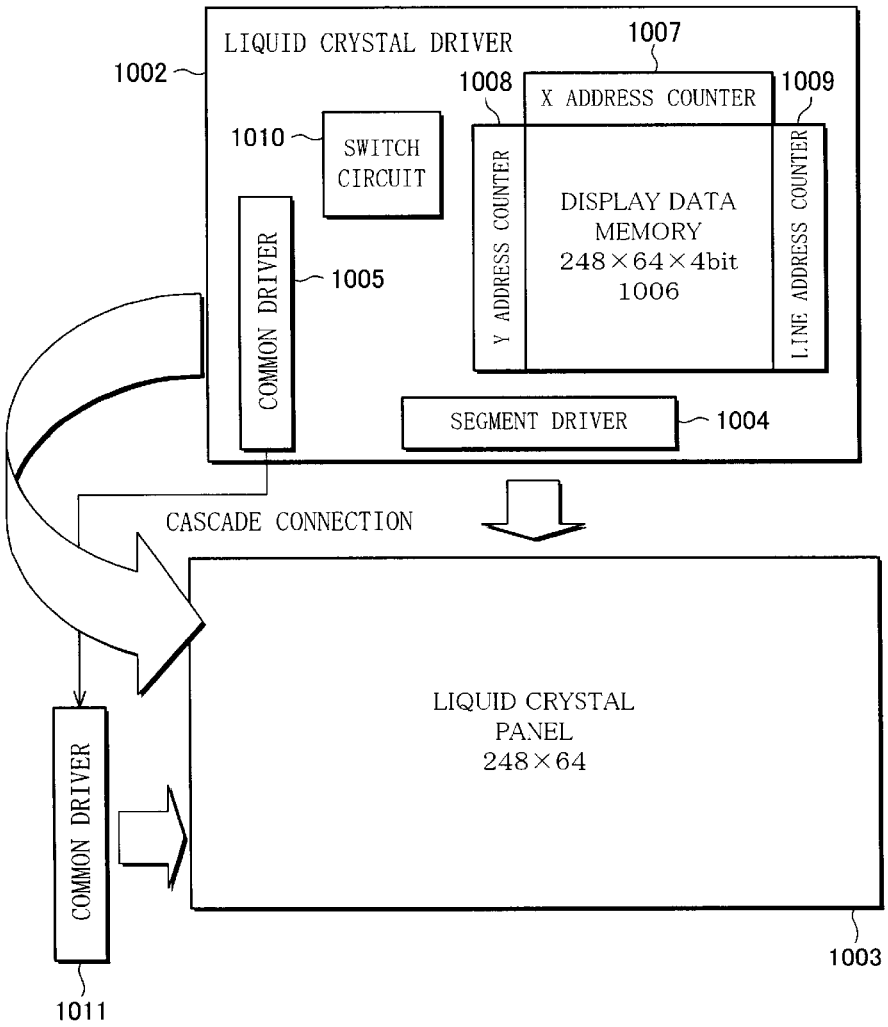
FIG. 2 is a drawing schematically showing a structure of a liquid crystal display device of a single-scan display mode, provided with the liquid crystal driving device shown in FIG. 1.

Referring to FIG. 2, the liquid crystal display device of the single-scan display mode is described below.

When the liquid crystal driver 1002 of FIG. 1 is used, the capacity of the display data memory 1006 is 248×32×8= 63488 bits. That is, the display data memory 1006 will be used in 248×64×4 bits, and the liquid crystal panel 1003 will be adapted to 16-tone display.

The Y address counter 1008 and the line address counter 1009 have the address space of 64 lines. Thus, this address space is directly counted to count the addresses of 64 lines.

The segment driver 1004 has 248 outputs, from which waveforms of tones according to the display data are outputted to the liquid crystal panel. The common driver 1005 has 32 outputs, from which scanning signals are successively outputted.

In the single-scan display mode, the liquid crystal driver 1002 is used in cascade with the additionally-provided common driver 1011 that drives 32 lines. The common driver 1011 basically has the same circuit structure as the common driver 1005 of the liquid crystal driver 1002.

The common driver 1005 normally operates to receive and transfer, in synchronism with a horizontal synchronize signal, a start pulse signal (scanning start signal from a CPU) through shift registers inside the common driver 1005.

The scanning signal is created based on the output from each of 32 stages of the shift registers.

In the single-scan display mode shown in FIG. 2, the start pulse signal which has been transferred through the shift registers of the common driver 1005 in the liquid crystal driver 1002 and outputted from the last stage of the shift registers is received by the shift registers of 32-stages in the external common driver 1011. The start pulse signal is then transferred through the shift registers in synchronism with a transfer clock, i.e., the horizontal synchronize signal, so as to make a cascade connection with the common driver 1005. The common driver 1011 is operated in this manner to successively select and scan the common lines of 64 lines.

Note that, switching between the dual-scan display mode and the single-scan display mode may be carried out by the switch circuit 1010 in response to a command from an external CPU, or by providing a switch terminal (not shown) in the liquid crystal driver 1002. The same applies to the Second through Fourth Embodiments described later.

As described thus far, the same liquid crystal driver 1002 can be used for the 256 tone display in the liquid crystal panel of the dual-scan display mode and for the 16-tone display in the liquid crystal panel of the single-scan display mode, without wasting any space in the display data memory 1006 in the liquid crystal driver 1002.

[Second Embodiment]

Figure 3:
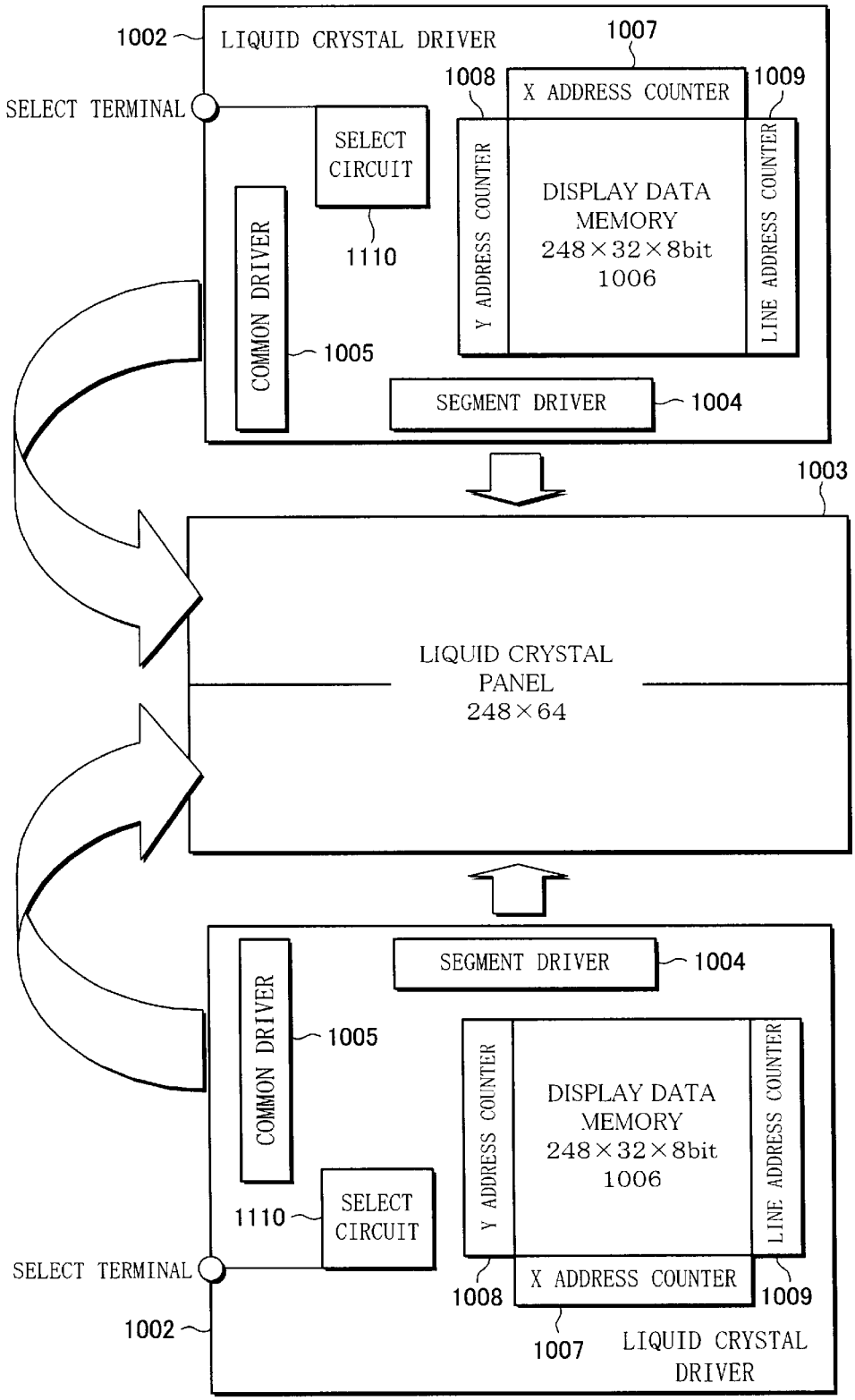
FIG. 3 is a drawing schematically showing a liquid crystal display device of the dual-scan display mode, provided with another liquid crystal driving device of the present invention.

The following will describe another embodiment of the present invention. FIG. 3 of the embodiment illustrates a liquid crystal display device of the dual-scan display mode, and FIG. 4 of the embodiment illustrates a liquid crystal display device of the single-scan display mode.

Figure 4:
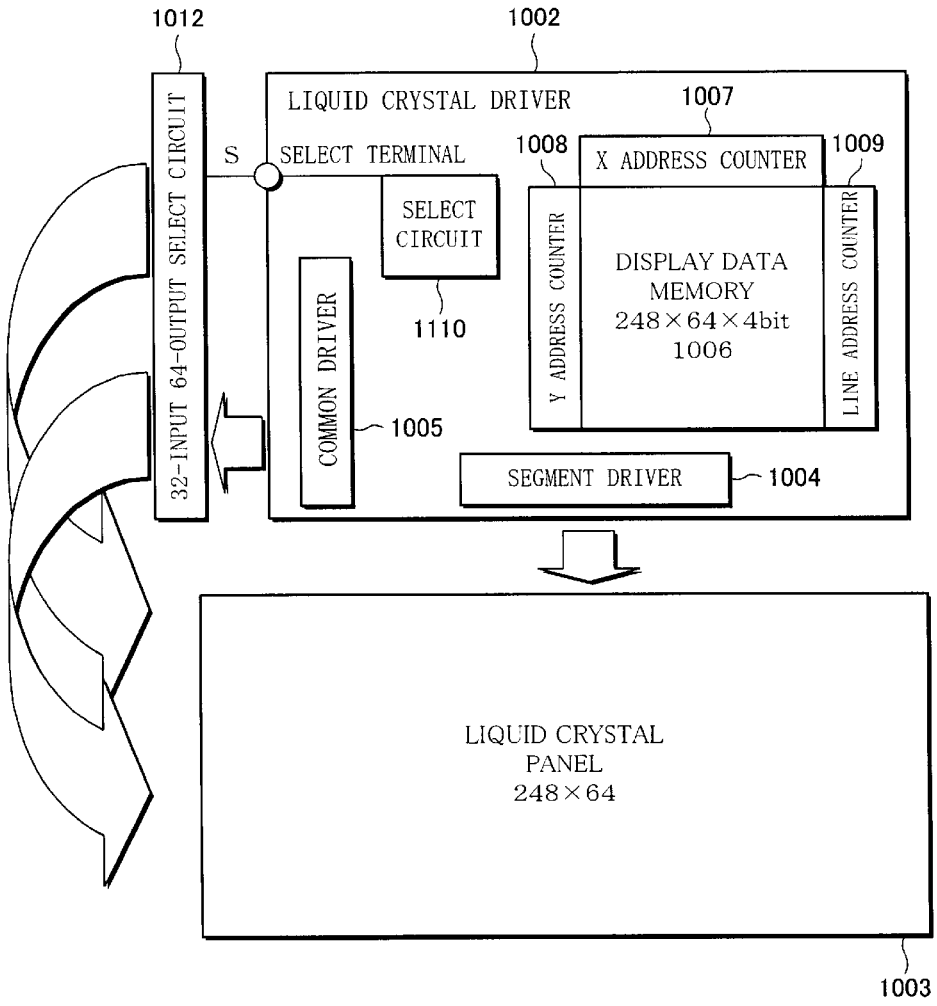
FIG. 4 is a drawing schematically showing a liquid crystal display device of the single-scan display mode, provided with the liquid crystal driving device shown in FIG. 3.

In the present embodiment, as shown in FIG. 4, the single-scan display mode employs an externally-provided output select circuit (output number converter circuit) 1012 of 32 inputs and 64 outputs, so as to enable a liquid crystal driver 1002 to adapt to both the dual-scan display mode and the single-scan display mode.

The switch circuit 1010 of the First Embodiment is replaced with a select circuit 1110 in the present embodiment.

The select circuit 1110, in addition to the function of the switch circuit 1010, has a function of outputting a switch signal S which switches between the first half (line 1 through line 32) and the second half (line 33 through line 64) of a scanning period in the single-scan display mode. The liquid crystal driver 1002 is additionally provided with an output terminal (select terminal) through which the select circuit 1110 outputs the switch signal S.

The switch signal S, when latched with a start pulse signal which is transferred through shift registers (32 stages) of the common driver 1005 in the liquid crystal driver 1002 and is outputted from the last stage of the shift registers for example, becomes Low level in the first half (line 1 through line 32) and High level in the second half (line 33 through line 64).

The switch signal S is not used in the operations of the dual-scan display mode shown in FIG. 3. That is, the operations in the dual-scan display mode are the same as those described in connection with the dual-scan display mode of the First Embodiment. Accordingly, no further explanation thereof will be given in the present embodiment.

Figure 5:
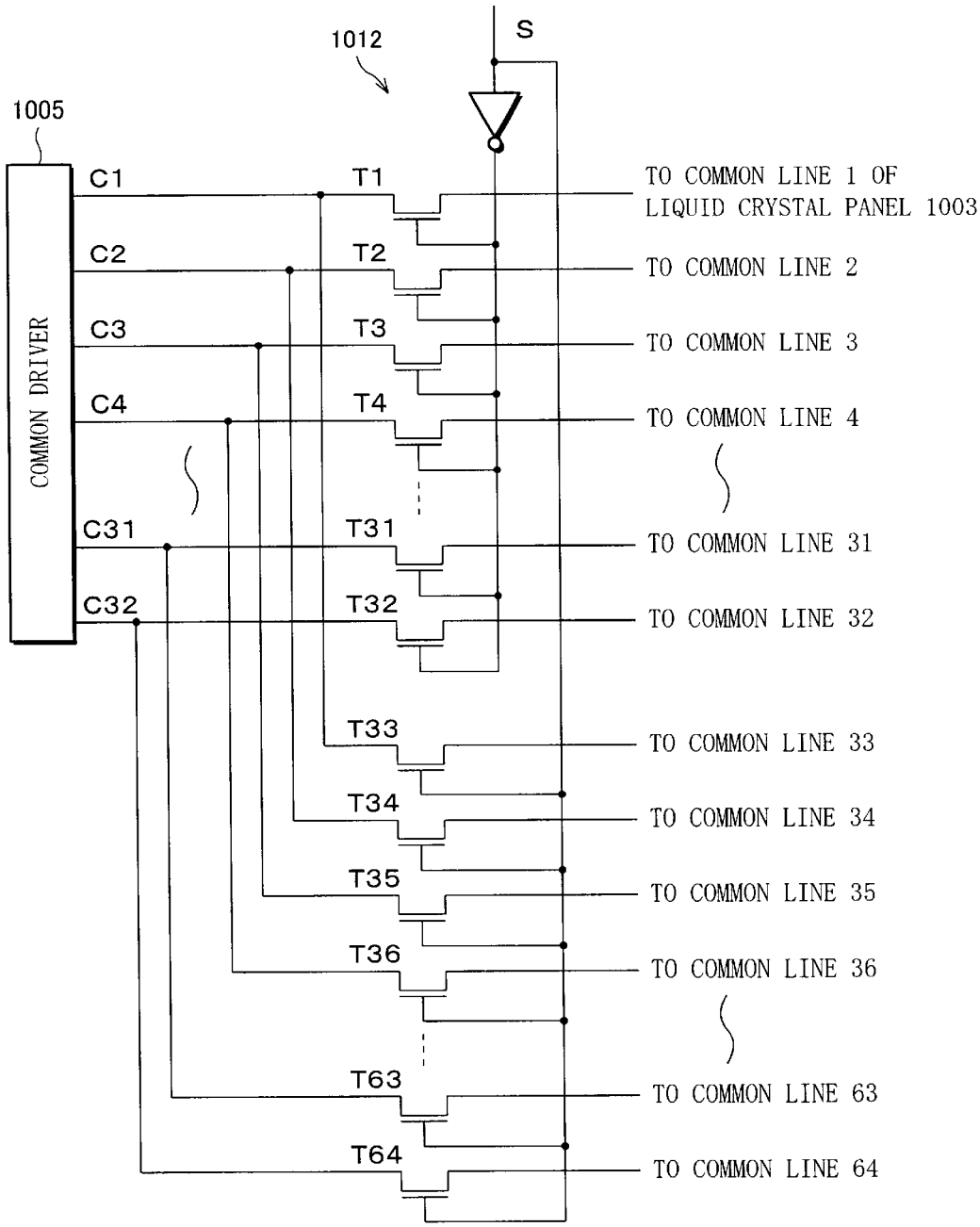
FIG. 5 is an explanatory drawing showing a 32-input 64-output select circuit shown in FIG. 4.

Referring to FIG. 4 and FIG. 5, the following describes a liquid crystal display device of the single-scan display mode.

In the liquid crystal display device shown in FIG. 4, the liquid crystal driver 1002 is externally provided with the select circuit 1012 of 32 inputs and 64 outputs.

The select circuit 1012 has a circuit structure as shown in FIG. 5, for example. Note that, the common driver shown in FIG. 5 is the common driver 1005 in the liquid crystal driver 1002.

As mentioned earlier, the switch signal S becomes Low level in the first half (line 1 through line 32) and High level in the second half (line 33 through line 64).

Thus, as FIG. 5 indicates, the output C1 from the common driver 1005 in the liquid crystal driver 1002 is connected via transistor T1 to the common line 1 of the liquid crystal panel 1003 and via transistor T33 to the common line 33 of the liquid crystal panel 1003.

In the same manner, the output Ck from the common driver 1005 in the liquid crystal driver 1002 is connected via transistor Tk to common line k of the liquid crystal panel and via transistor T32+k to common line 32+k of the liquid crystal panel. Here, k takes a value of 1 to 32.

The gate of the transistors T1 through T32 receives the inverted signal of the switch signal S via an inverter, and the gate of the transistors T33 through T64 receives the switch signal S.

Thus, the common line 1 through common line 32 of the liquid crystal panel 1003 are successively selected and scanned in the first half, whereas, in the second half, the common line 33 through common line 64 of the liquid crystal panel 1003 are successively selected and scanned in response to scanning signals successively outputted again through C1 through C32 from the common driver in response to the start pulse signal.

Note that, the transistors in the output select circuit 1012 may be realized by analog switches such as a MOS transistor or a transmission gate.

Further, the output select circuit 1012, that is externally provided, may alternatively be installed in the liquid crystal driver 1002. In this case, the absence of external switch signal S can be compensated for by fixing the switch signal S at Low level in the dual-scan display mode, so as to accommodate 32 lines.

The provision of the output select circuit 1012 enables the driving signal to scan the upper part of the liquid crystal panel 1003 in the first scanning period (first half) and scan the lower part of the liquid crystal panel 1003 in the second scanning period (second half).

The segment driver 1004 operates in the same way as in the single-scan display mode as already described in connection with FIG. 2 of the First Embodiment. Accordingly, a further explanation thereof is omitted here.

As described thus far, the same liquid crystal driver 1002 can be used for the 256 tone display in the liquid crystal panel of the dual-scan display mode and for the 16-tone display in the liquid crystal panel of the single-scan display mode, without wasting any space in the display memory in the liquid crystal driver.

[Third Embodiment]

Figure 6:
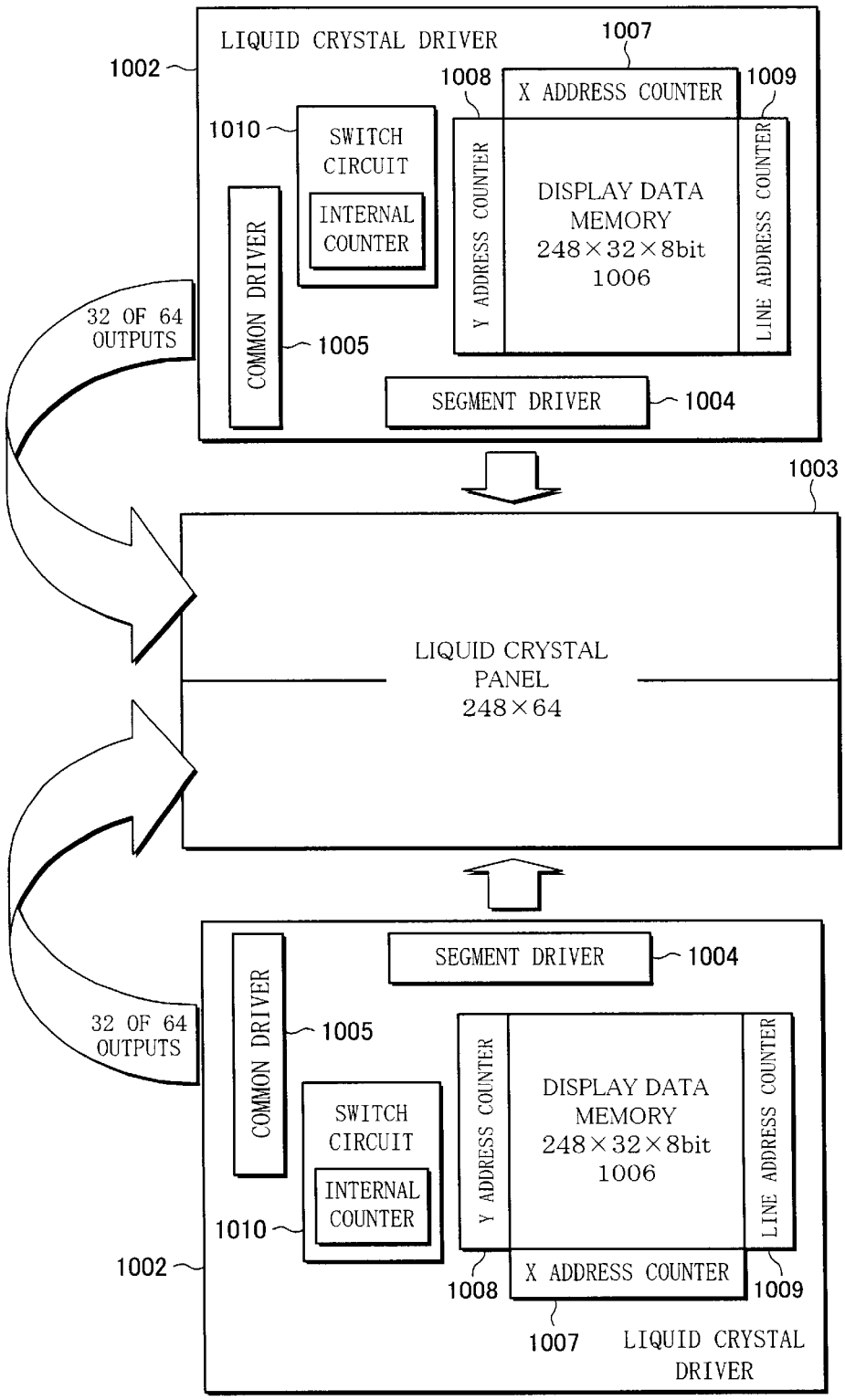
FIG. 6 is a drawing schematically showing a liquid crystal display device of the dual-scan display mode, provided with yet another liquid crystal driving device of the present invention.

The following will describe yet another embodiment of the present invention. FIG. 6 of the embodiment illustrates a liquid crystal display device of the dual-scan display mode, and FIG. 7 of the embodiment illustrates a liquid crystal display device of the single-scan display mode.

The present embodiment describes a liquid crystal driving device that is provided with a common driver, that has adapted to the single-scan display mode, for driving 64 lines, and an internal counter, provided in the switch circuit 1010, for switching between 32 lines and 64 lines.

Accordingly, the common driver has shift registers of 64 stages. In the single-scan display mode, the start pulse signal is transferred through all the 64 stages and the scanning signal is created based on the output of each shift register stage so as to accommodate 64 lines.

On the other hand, in the dual-scan display mode, the shift registers stop outputting at the 32nd stage. This can be realized in the dual-scan display mode, for example, by stopping the transfer clock of the shift registers when the internal counter finishes counting 32 lines. In this way, the common driver can switch itself to serve as the common driver that drives 32 lines.

Referring to FIG. 6, the following describes a liquid crystal display device of the dual-scan display mode.

A liquid crystal panel 1003, which is a matrix-type STN liquid crystal display device with 248 segment lines and 64 common lines, is divided into an upper part and a lower part that are separately driven in the dual-scan display mode.

A liquid crystal driver 1002 has a display data memory 1006 of 248×32×8 bits and a tone display capability of 256 tones. A Y address counter 1008 and a line address counter 1009 have the address space of 64 lines and count the addresses of 32 lines in the dual scanning mode.

A segment driver 1004 has 248 outputs, from which waveforms of tones according to the display data are outputted to the liquid crystal panel 1003.

The common driver 1005 has 64 outputs, among which the 1st through 32nd outputs successively output scanning signals, while no scanning signals are outputted from the 33rd through 64th outputs.

Figure 7:
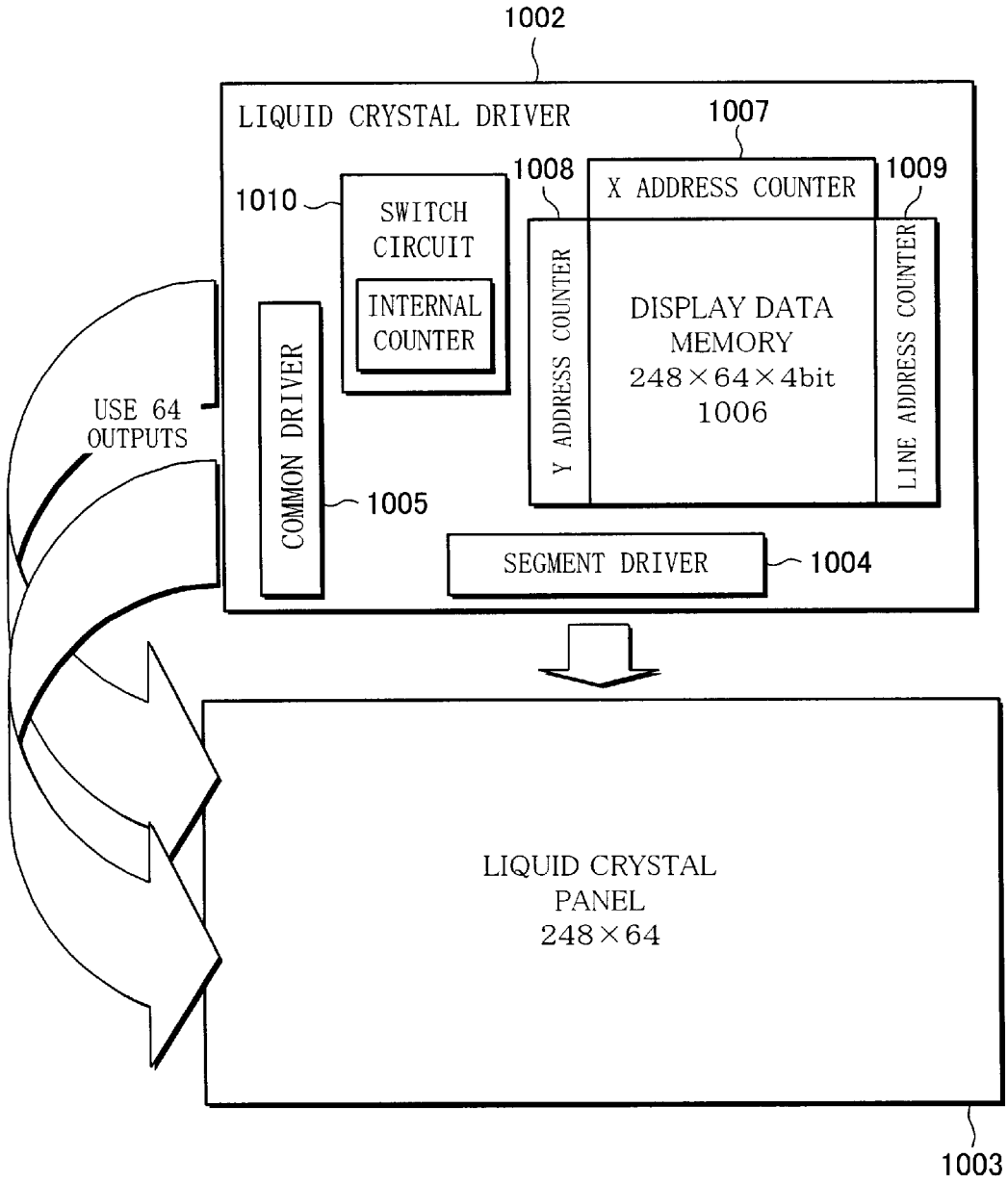
FIG. 7 is a drawing schematically showing a liquid crystal display device of the single-scan display mode, provided with the liquid crystal driving device shown in FIG. 6.

Referring to FIG. 7, the following describes a liquid crystal display device of the single-scan display mode.

FIG. 7 shows the liquid crystal display device that is driven in the single-scan display mode, using the liquid crystal driver 1002 of FIG. 6.

A display data memory 1006 is used in 248×64×4 bits, and therefore the display has 16 tones. A Y address counter 1008 and a line address counter 1009 have the address space of 64 lines, and the addresses of 64 lines are counted during the single scan.

Because the address space of the Y address counter 1008 and the line address counter 1009 is of 64 lines, this address space is directly used to count the addresses of 64 lines.

A segment driver 1004 has 248 outputs, from which waveforms of tones according to the display data are outputted to the liquid crystal panel. A common driver 1005 has 32 outputs, from which scanning signals are successively outputted.

In the single-scan display mode, the liquid crystal driver 1002 is used by being connected to an additionally-provided common driver 1011 that drives 32 lines. The common driver 1011 basically has the same circuit structure as the common driver 1005 of the liquid crystal driver 1002.

The common driver 1005 normally operates to receive and transfer, in synchronism with a horizontal synchronize signal, a start pulse signal (scanning start signal from a CPU) through shift registers inside the common driver 1005.

The scanning signal is created based on the output from each of 32 stages of the shift registers.

As described thus far, the same liquid crystal driver 1002 can be used for the 256 tone display in the liquid crystal panel of the dual-scan display mode and for the 16-tone display in the liquid crystal panel of the single-scan display mode, without wasting any space in the display memory in the liquid crystal driver.

[Fourth Embodiment]

Figure 8:
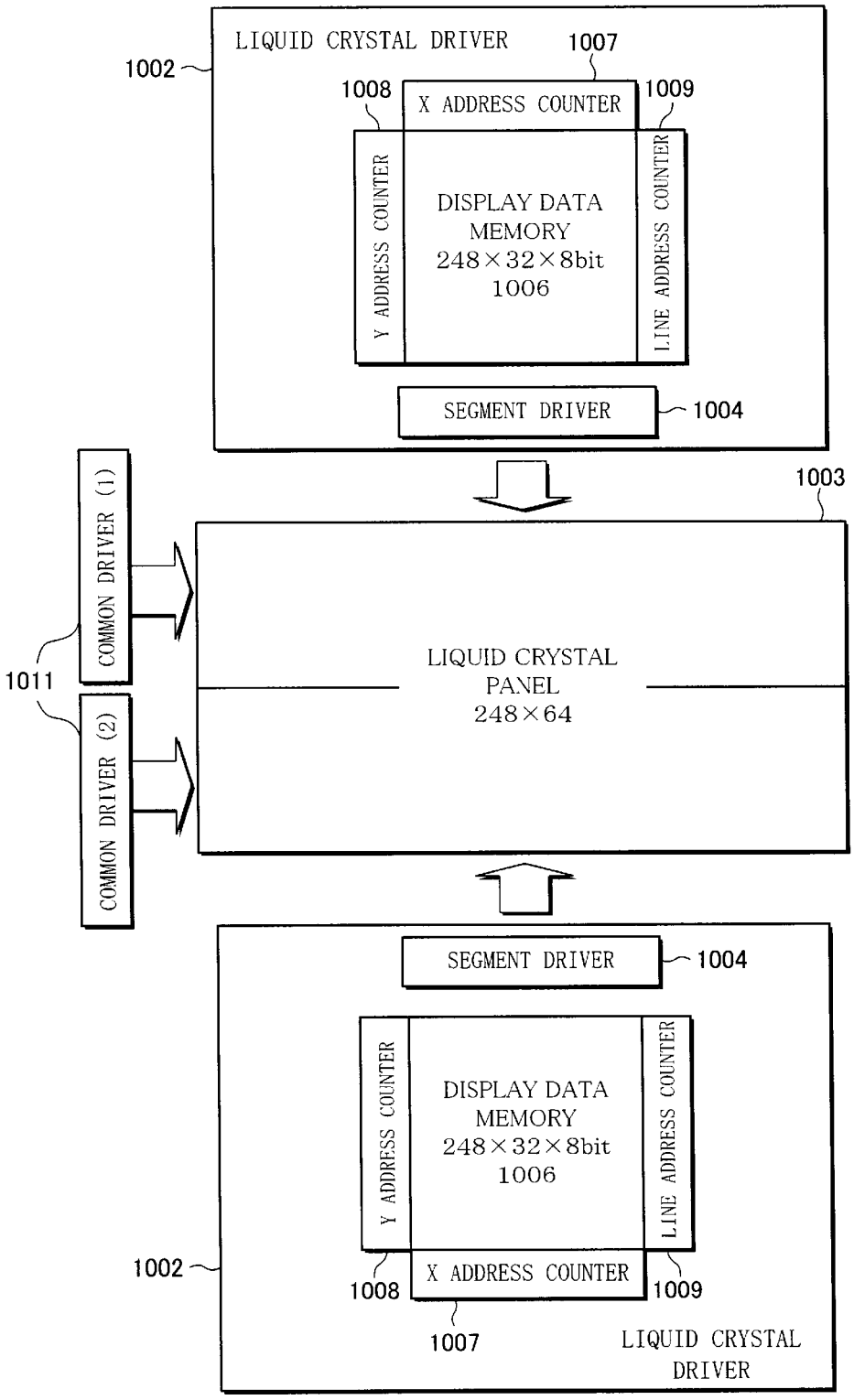
FIG. 8 is a drawing schematically showing a liquid crystal display device of the dual-scan display mode, provided with yet another liquid crystal driving device of the present invention.

The following will describe yet another embodiment of the present invention. FIG. 8 of the embodiment illustrates a liquid crystal display device of the dual-scan display mode, and FIG. 9 of the embodiment illustrates a liquid crystal display device of the single-scan display mode.

The present embodiment differs from the previous embodiments in that the common driver is not installed in the liquid crystal driver 1002, and the liquid crystal driver 1002 of the present embodiment is realized by a single LSI chip including a segment driver 1004 for driving 248 lines, a display data memory 1006 with a capacity of 248×32×8 bits, a control circuit for controlling the display data memory, and a switch circuit 1010 for switching the address space of the display data memory between a pixel area and a tone display area.

The control circuit for controlling the display data memory 1006 is realized by an X address counter 1007, a Y address counter 1008, a line address counter 1009, and an interface circuit (not shown) or a command decoder (not shown) that receives a control signal from an external CPU, and the like.

Figure 9:
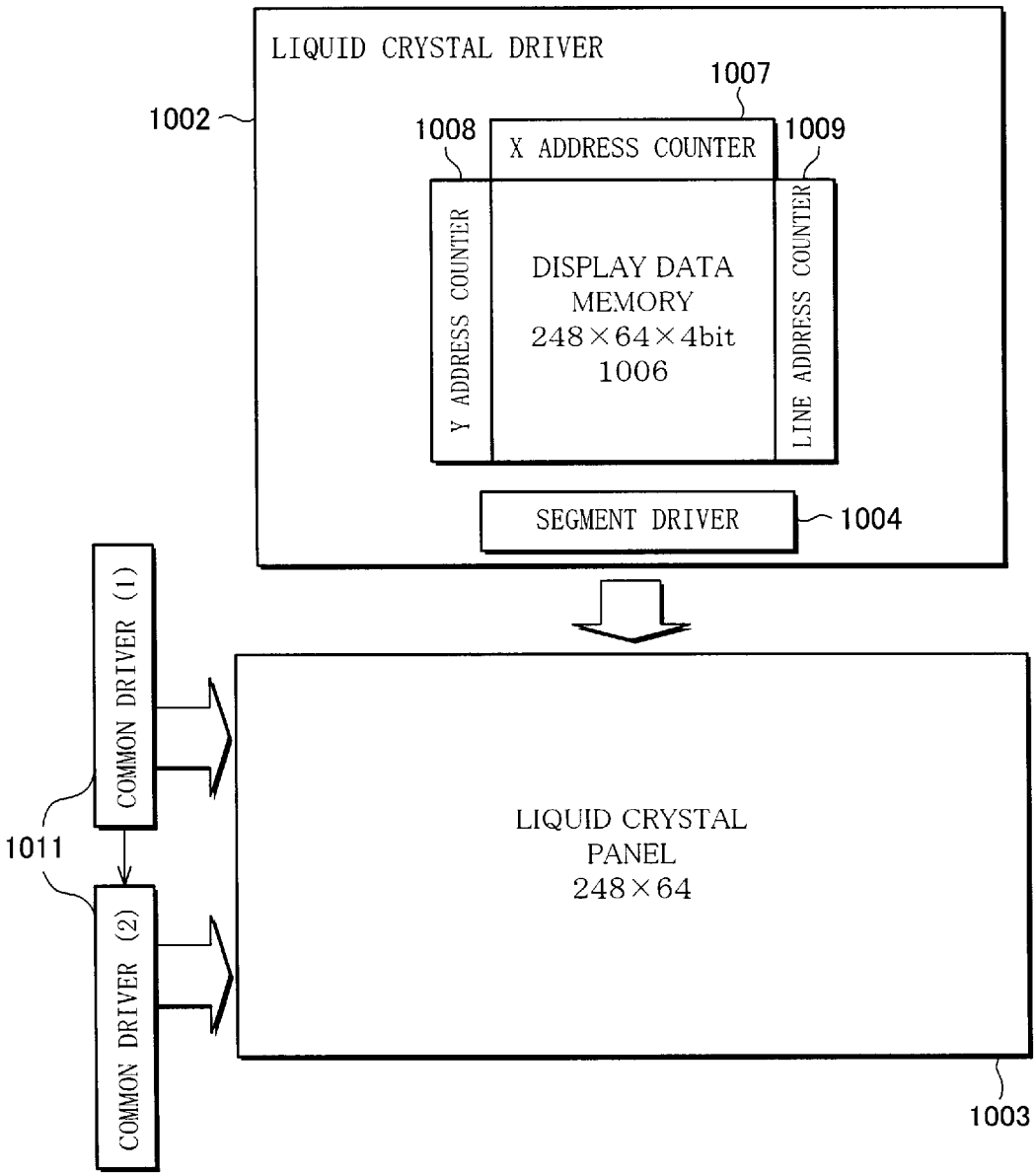
FIG. 9 is a drawing schematically showing a liquid crystal display device of the single-scan display mode, provided with the liquid crystal driving device shown in FIG. 8.
Figure 10:
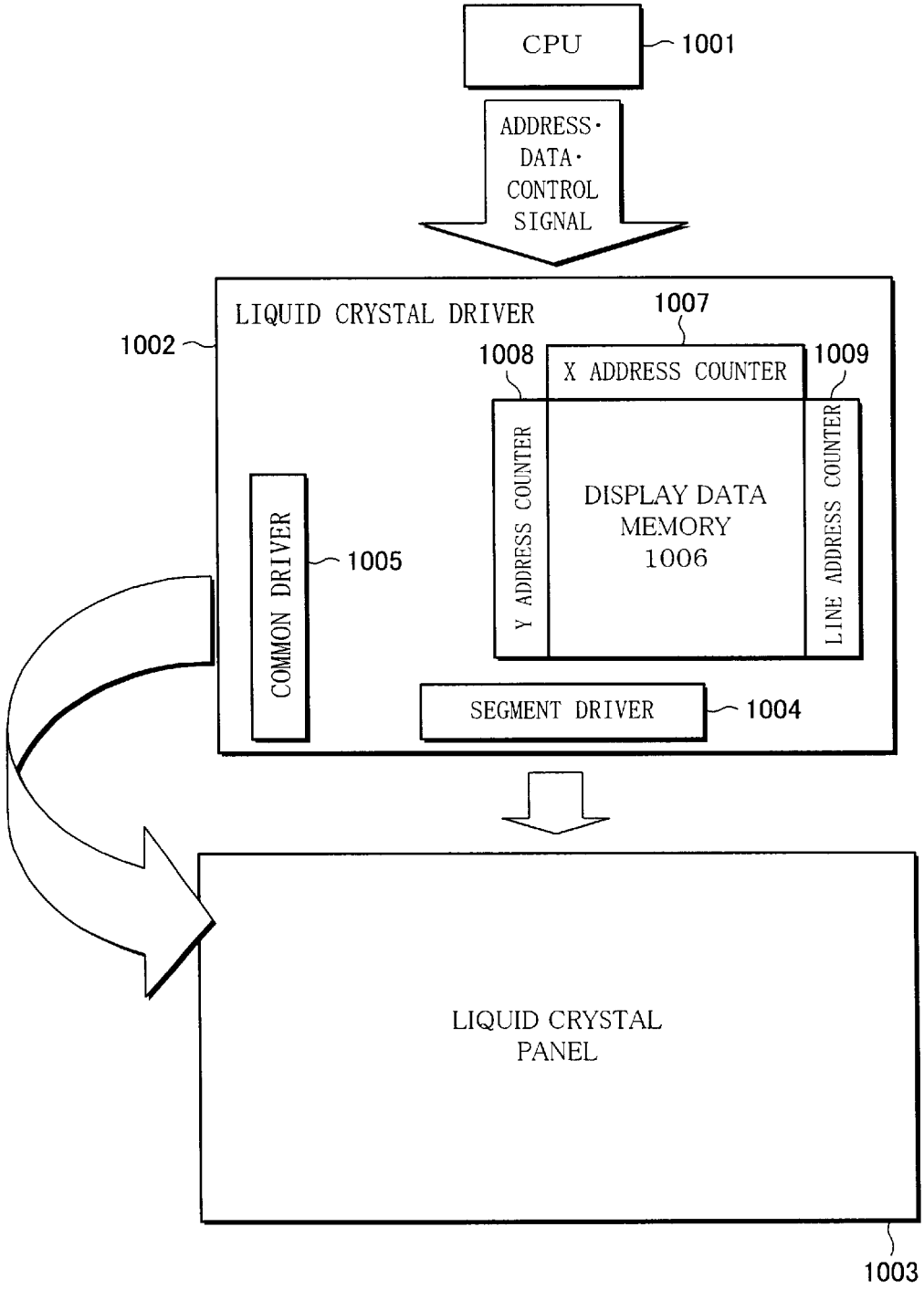
FIG. 10 is a drawing schematically showing a liquid crystal display device of the single-scan display mode, provided with a common liquid crystal driving device.

That is, as shown in FIG. 8 and FIG. 9, two common drivers 1011 for respectively driving 32 lines are provided in a single chip, separately from the liquid crystal driver 1002. Note that, in the liquid crystal display device of the single-scan display mode shown in FIG. 9, the two common drivers 1011 are connected to each other in cascade.

In the dual-scan display mode, the common driver (1) for driving common line 1 through common line 32 in the upper half of the liquid crystal panel 1003 is used together with the common driver (2), identical with the common driver (1), for driving common line 33 through common line 64 in the lower half of the liquid crystal panel 1003, so as to carry out driving with the liquid crystal driver 1002.

In the single-scan display mode, the common drivers (1) and (2) are connected to each other in cascade, so as to carry out driving with the liquid crystal driver 1002.

The liquid crystal panel 1003, which is a matrix-type STN liquid crystal display device with 248 segment lines and 64 common lines, is divided into an upper part and a lower part that are separately driven in the dual-scan display mode.

The liquid crystal driver 1002, with the display data memory of 248×32×8 bits, is capable of displaying 256 tones.

The Y address counter 1008 and the line address counter 1009 have the address space of 64 lines, and the addresses of 32 lines are counted during the dual scan.

The segment driver 1004 has 248 outputs, from which waveforms of tones according to the display data are outputted to the liquid crystal panel.

The common driver 1011, which is realized by an LSI separately from the liquid crystal driver 1002, has 32 outputs, from which scanning signals are successively outputted.

Referring to FIG. 9, the following describes the liquid crystal display device of the single-scan display mode.

FIG. 9 shows the liquid crystal display device that is driven in the single-scan display mode, using the liquid crystal driver 1002 of FIG. 8.

The display data memory 1006 is used in 248×64×4 bits and therefore the display has 16 tones.

The Y address counter 1008 and the line address counter 1009 have the address space of 64 lines, and the addresses of 64 lines are counted during the single scan.

The segment driver 1004 has 248 outputs, from which waveforms of tones according to the display data are outputted to the liquid crystal panel 1003.

The common drivers 1011, each with 32 outputs, are realized by two LSIs which successively output scanning signals. The two LSIs are connected to each other in cascade to output scanning signals from 64 outputs. Note that, instead of the two LSIs of 32 outputs each, a single LSI of 64 outputs may be provided.

As described thus far, the same liquid crystal driver 1002 can be used for the 256 tone display in the liquid crystal panel of the dual-scan display mode and for the 16-tone display in the liquid crystal panel of the single-scan display mode, without wasting any space in the display memory in the liquid crystal driver.

Note that, the foregoing embodiments described the case where 256 tones and 16 tones are used in combination. However, not limiting to this, 64 tones and 8 tones may also be used, for example. Further, under the same principle, a driver of 256 tones may be used and the display memory may be divided into two display screens of 8 tones each and a display screen of 4 tones, so that the display memory can be used by switching between these display screens.

In the described embodiments, the addresses of the display data memory 1006 (display memory) that stores display data are changed. This enables the same liquid crystal driving device to be used regardless of the number of tones of the display mode, as in the dual-scan display mode and the single-scan display mode.

Because the same liquid crystal driving device can be used between display modes with different numbers of tones, the effect of mass-production, enabled by the same liquid crystal display device produced in mass quantity, can be attained. That is, the cost per liquid crystal display device can be reduced, thereby reducing the production cost of the liquid crystal display device.

Further, because the capacity of the display data memory 1006 remains the same regardless of the number of tones, the cost of the liquid crystal driving device will not be increased by an increased memory capacity.

The liquid crystal display devices of the present invention have the following effects.

When high-quality and multi-tone (256 tones in the embodiments) display is needed, two liquid crystal drivers, respectively corresponding to the upper and lower parts of the display, are used to realize a driving circuit for the dual scan, whereas when such display is not needed, a smaller number of tones (16 tones in the embodiments) is used to realize a driving circuit for the single scan, using the same driver as that for the dual scan. In this way, the same product can be used between the two display modes to reduce cost.

Increasing the number of pixels or number of tones to improve image quality or to accommodate multi-tone display increases the memory size of the installed display data memory by many orders of magnitude. Conventionally, this resulted in a larger chip size and a higher cost for the liquid crystal driver. By using the same liquid crystal driver between the dual-scan display and the single-scan display, the effect of mass-production can be expected to reduce cost.

Setting aside the size of the display data memory, the segment driver occupies a relatively large area of the chip when the segment driver includes shift registers, a hold memory, a tone pulse selecting circuit, and an output circuit.

The common driver, on the other hand, is basically realized by the shift registers and the output circuit, and thus occupies a relatively small area of the chip.

Further, the output select circuit of 32 inputs and 64 outputs used in the liquid crystal display device of FIG. 4 also occupies a small area of the chip, and thus the external common driver and the output select circuit of 32 inputs and 64 outputs can be provided inexpensively.

Note that, the foregoing embodiments described the case where the liquid crystal driver with the display data memory of 248×32×8 bits is used for the display of 248×32 pixels in 256 tones in the dual-scan display, and the liquid crystal driver is switched to display 248×64 pixels in 16 tones in the single-scan display. However, the single-scan display may be adapted to display 248×128 pixels in 8 tones. In this case, four external common drivers (for 32 lines) are connected in cascade.

In this manner, in the matrix-type STN liquid crystal display device, switching between the pixel area and the tone display area may be carried out on a larger pixel area, provided that deficiencies, such as flicker, are not recognized.

Figure 11:
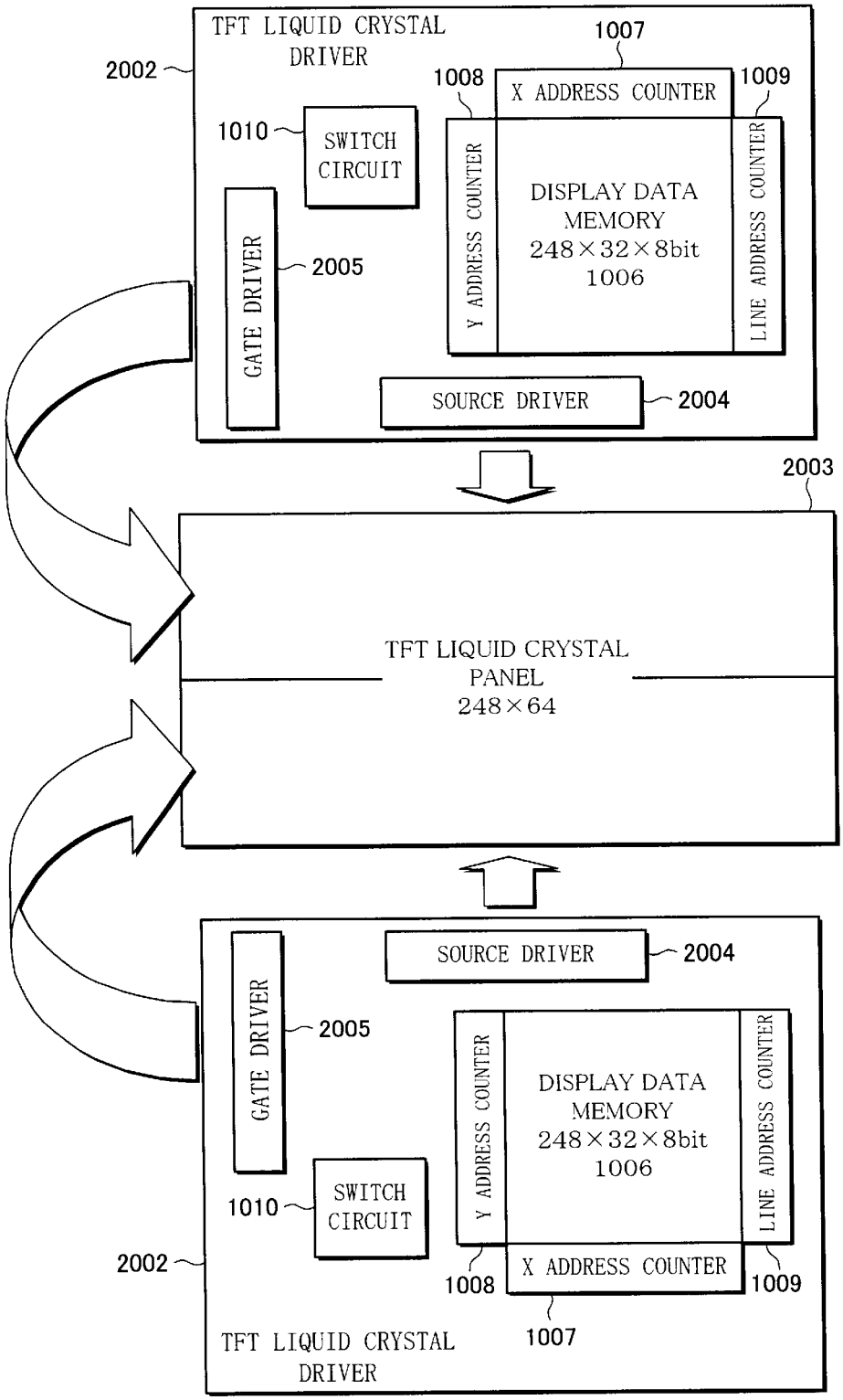
FIG. 11 is a drawing schematically showing a TFT liquid crystal display device of the dual-scan display mode, provided with a liquid crystal display device of the present invention.
Figure 12:
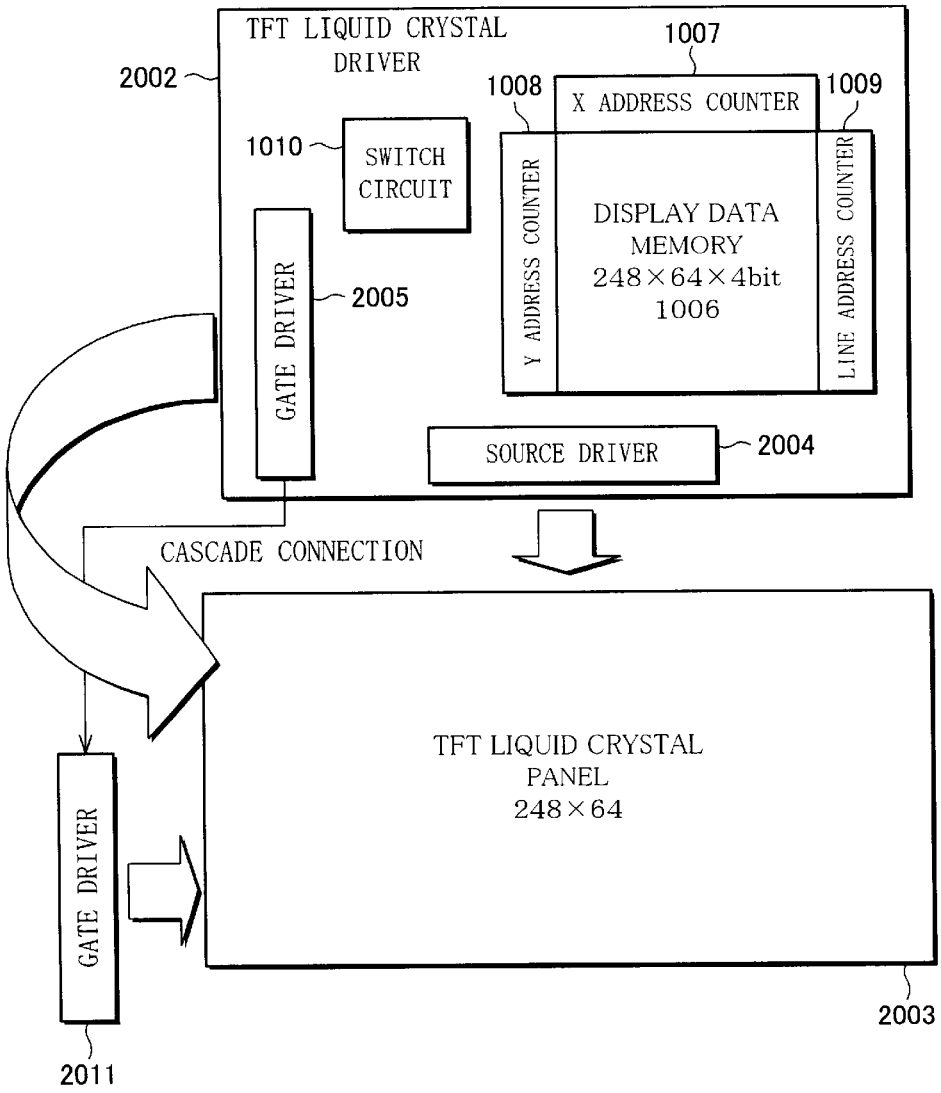
FIG. 12 is a drawing schematically showing a TFT liquid crystal display device of the single-scan display mode, provided with the liquid crystal driving device shown in FIG. 11.

Further, the display data memory can easily be switched between the pixel area and the tone display area, and the external circuit can easily be provided for the common driver also in the TFT driving mode, by replacing the segment driver with a source driver and the common driver with a gate driver. For example, the present invention can easily be applied to the TFT driving mode by replacing the liquid crystal driver 1002, the liquid crystal panel 1003, the segment driver 1004, the common driver 1005, and the external common driver 1011 of FIG. 1 with a TFT liquid crystal driver 2002, a TFT liquid crystal panel 2003, a source driver 2004, and an external gate driver 2011, respectively, as shown in FIG. 11 and FIG. 12.

By thus switching the area of the display data memory between the pixel area and the tone display area, the same driver can be used to realize liquid crystal display devices that are more versatile. For example, where multi-tone display is not often required, the liquid crystal driver can be used to realize a liquid crystal display device with only a small number of tones but with a large number of pixels to display characters or cartoon images for example, whereas the same liquid crystal driver can also be used to realize a liquid crystal display device which is more multi-tone display oriented, such as a portable phone display of a small screen size and with a relatively small number of pixels.

In order to attain this effect, the present invention proposes other types of liquid crystal driving devices. That is, the liquid crystal driving device may be adapted to include a circuit, with a display data memory installed therein, for driving a matrix-type liquid crystal display device, wherein the number of bits of the display memory expressing tones is halved during the single scan in which the display area is doubled, so as to enable the circuit to be used in the dual scan as well as in the single scan.

Further, in order to use the same liquid crystal driving device in the dual scan as well as in the single scan, the liquid crystal display device may be adapted so that the circuit for addressing the installed memory is set for the single scan to vacate an address space that is not required in the dual scan.

Further, the liquid crystal driving device may be adapted to include external common drivers that are connected to each other in cascade.

Further, in order to use the same liquid crystal driving device in the dual scan as well as in the single scan, the liquid crystal driving device may be adapted so that the number of outputs of the common driver is set for the single scan to vacate outputs that are not required in the dual scan.

Further, in order to use the same liquid crystal driving device in the dual scan as well as in the single scan, the liquid crystal driving device may be adapted so that the number of outputs of the common driver is set for the dual scan, and the number of outputs of the common driver is doubled by providing an external selector that is connected to the liquid crystal driving device.

That is, the display data memory is adapted to have a capacity that can be divided into two parts, and a device is provided that can switch addressing of the memory between multi-tone display in the dual scan and simple-tone display in the single scan.

In the case where the common driver and the segment driver are provided in a single LSI chip, an external common driver for the single scan is provided.

According to the foregoing configuration, a single liquid crystal driver that carries out multi-tone display in the dual scan can be used to drive a simple-tone panel in the single scan. In this way, the same component can be shared between a high-end display panel and a low-end display panel to reduce cost.

As described, a liquid crystal driving device of the present invention is provided with a display memory which stores display data to be supplied to a matrix-type liquid crystal display panel having pixels that are disposed in row and column directions in a matrix for displaying $2^k$ tones (k being a natural number), and a column driver of m outputs (m being a natural number) and a row driver of n outputs (n being a natural number), and the liquid crystal driving device includes: display memory control means for varying a value n and a value k of m×n×k bits, which is a capacity of the display memory, while holding n×k bits of m×n×k bits constant; and output number setting means for setting a number of outputs of the row driver such that the n value varied by the display memory control means becomes the number of outputs of the row driver.

That is, the display memory control means varies value n and value k to change the address of stored display data in the display memory of m×n bits. The change of value n and value k does not bring about a change of a capacity (m×n×k) of the display memory because n×k is held constant.

Varying value k changes the number of tones of the matrix-type liquid crystal display panel, and varying value n changes the number of outputs of the row driver.

Thus, by varying value n and value k, the number of outputs of the row driver can be set according to the number of tones, without changing the capacity of the display memory.

Despite these different display modes with different numbers of tones, the same liquid crystal driving device can be used in the dual-scan display mode as well as in the single-scan display mode by varying a value n and a value m of m×n×k bits, which is a capacity of the display memory, while holding n×k bits of m×n×k bits constant, and setting a number of outputs of the row driver such that the n value varied by the display memory control means becomes the number of outputs of the row driver.

By thus enabling the same liquid crystal driving device to be shared between different display modes with different numbers of tones, the effect of mass-production can be expected. That is, the cost per liquid crystal driving device can be reduced, thereby reducing the production cost of the liquid crystal display device.

Further, because the capacity of the display memory remains the same regardless of the number of tones, the cost of the liquid crystal driving device will not be increased by an increased memory capacity.

Further, another liquid crystal driving device of the present invention is provided with a display memory which stores display data to be supplied to a matrix-type liquid crystal display panel having pixels that are disposed in row and column directions in a matrix, and column and row drivers for driving the matrix-type liquid crystal display panel, and the liquid crystal driving device includes: setting means for setting a count of addresses of a display data storing area of the display memory, so as to set a number of outputs of the row driver according to the count, wherein the setting means varies the count of addresses between a dual-scan display mode in which two parts of a display screen of the matrix-type liquid crystal display panel, that has been divided into two parts in a row direction, are simultaneously driven to carry out display, and a single-scan display mode in which the display screen of the matrix-type liquid crystal display panel is directly driven to carry out display.

That is, the count of addresses of the display data storage area of the display memory is varied between the dual-scan display mode and the single-scan display mode, and the number of outputs of the row driver is changed according to this count. This enables the same liquid crystal driving device to be used between liquid crystal display devices of the single-scan display mode and liquid crystal display devices of the dual-scan display mode.

By thus enabling the same liquid crystal driving device to be shared between different display modes (dual-scan display mode and single-scan display mode) with different numbers of address counts of the display data storage area of the display memory, the effect of mass-production can be expected. That is, the cost per liquid crystal driving device can be reduced, thereby reducing the production cost of the liquid crystal display device.

The setting means may set the count of addresses such that the count of addresses in the dual-scan display mode is less than the count of addresses in the single-scan display mode.

In this case, the address space (count of addresses) that is not required in the dual scan can be vacated.

Further, the setting means may set the number of outputs of the row driver such that the number of outputs of the row driver in the dual-scan display mode becomes half the number of outputs of the row driver in the single-scan display mode.

In this case, the outputs that are not required in the dual scan can be vacated.

Further, the row driver whose output number has been set by the setting means to adapt to the dual-scan display mode may be connected in cascade to another row driver.

In this case, the cascade connection between the row driver whose output number has been set by the setting means to adapt to the dual-scan display mode and another row driver allows for increased numbers of outputs for the row signals supplied to the matrix-type liquid crystal panel in the single-scan display mode. This enables the same liquid crystal driving device to be used in liquid crystal display devices of the dual-scan display mode and liquid crystal display devices of the single-scan display mode.

Further, the row driver whose output number has been set by the setting means to adapt to a dual-scan display mode may be provided with an output number converter circuit that doubles the number of outputs of the row driver.

In this case, by doubling the number of outputs of the dual-scan display mode by the output number converting means in the single-scan display mode, the row driver whose output number has been adapted to the dual-scan display mode can also adapt to the single-scan display mode. This enables the same liquid crystal driving device to be used in liquid crystal display devices of the dual-scan display mode and liquid crystal display devices of the single-scan display mode.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A liquid crystal driving device, comprising:

a matrix-type liquid crystal display panel, having pixels that are disposed in row and column directions in a matrix, for displaying $2^k$ tones (k being a natural number);

a display memory, which stores display data to be supplied to said matrix-type liquid crystal panel;

a column driver of m outputs (m being a natural number);

a row driver of n outputs (n being a natural number);

display memory control means for varying a value n and a value k of m×n×k bits, which is a capacity of said display memory, while holding n×k bits of m×n×k bits constant; and output number setting means for setting a number of outputs of said row driver such that the n value varied by said display memory control means becomes the number of outputs of said row driver.

2. A liquid display driving device, comprising:

a matrix-type liquid crystal display panel having pixels that are disposed in row and column directions in a matrix;

a display memory, which stores display data to be supplied to said matrix-type liquid crystal display panel;

row and column drivers for driving said matrix-type liquid crystal display panel; and setting means for setting a count of addresses of a display data storing area of said display memory, so as to set a number of outputs of said row driver according to the count, wherein said setting means varies the count of addresses between a dual-scan display mode in which two parts of a display screen of said matrix-type liquid crystal display panel, that has been divided into two parts in a row direction, are simultaneously driven to carry out display, and a single-scan display mode in which the display screen of said matrix-type liquid crystal display panel is directly driven to carry out display.

3. The liquid crystal driving device as set forth in claim 2, wherein said setting means sets the count of addresses such that the count of addresses in the dual-scan display mode is less than the count of addresses in the single-scan display mode.

4. The liquid crystal driving device as set forth in claim 2, wherein said setting means sets the count of addresses of said display memory such that the number of outputs of said row driver in a dual-scan display mode becomes half the number of outputs of said row driver in a single-scan display mode.

5. The liquid crystal driving device as set forth in claim 2, wherein the row driver whose output number has been set by said setting means to adapt to a dual-scan display mode is connected in cascade to another row driver.

6. The liquid crystal driving device as set forth in claim 2, wherein the row driver whose output number has been set by said setting means to adapt to a dual-scan display mode is provided with an output number converter circuit that doubles the number of outputs of the row driver.

* * * * *